US006981561B2

(12) United States Patent
Krueger et al.

(10) Patent No.: US 6,981,561 B2
(45) Date of Patent: Jan. 3, 2006

(54) DOWNHOLE CUTTING MILL

(75) Inventors: Sven Krueger, Winsen/Aller (DE); Volker Krueger, Celle (DE); Harald Grimmer, Lachendorf (DE); Joerg Christanseen, Winsen/Aller (DE); Volker Peters, Wienhausen (DE)

(73) Assignee: Baker Hughes Incorporated, Houston, TX (US)

( * ) Notice: Subject to any disclaimer, the term of this patent is extended or adjusted under 35 U.S.C. 154(b) by 87 days.

(21) Appl. No.: 10/653,334

(22) Filed: Sep. 2, 2003

(65) Prior Publication Data

US 2004/0112642 A1 Jun. 17, 2004

Related U.S. Application Data

(63) Continuation-in-part of application No. 10/251,138, filed on Sep. 20, 2002, now abandoned.

(60) Provisional application No. 60/323,803, filed on Sep. 20, 2001.

(51) Int. Cl.
*E21B 21/00* (2006.01)

(52) U.S. Cl. ..... 175/312; 175/96

(58) Field of Classification Search ..... 175/206, 175/207, 215, 217, 312, 96, 107
See application file for complete search history.

(56) References Cited

U.S. PATENT DOCUMENTS

| | | | |
|---|---|---|---|
| 2,812,723 | A | 11/1957 | Coberly |
| 2,946,565 | A | 7/1960 | Williams |
| 3,595,075 | A | 7/1971 | Dower |
| 3,603,409 | A | 9/1971 | Watkins |
| 3,677,353 | A | 7/1972 | Baker |
| 3,815,673 | A | 6/1974 | Bruce et al. |
| 3,958,651 | A | 5/1976 | Young |
| 4,022,285 | A | 5/1977 | Frank |
| 4,049,066 | A | 9/1977 | Richey |
| 4,063,602 | A | 12/1977 | Howell et al. |
| 4,091,881 | A | 5/1978 | Maus |
| 4,099,583 | A | 7/1978 | Maus |
| 4,108,257 | A | 8/1978 | Sizer |
| 4,134,461 | A | 1/1979 | Blomsma |

(Continued)

FOREIGN PATENT DOCUMENTS

CA WO 02/14649 2/2002

(Continued)

OTHER PUBLICATIONS

*New Tool Addresses ECD Problem*, William Furlow, Offshore, pp. 88, 89, Jun. 2002.

(Continued)

*Primary Examiner*—Frank S. Tsay
(74) *Attorney, Agent, or Firm*—Madan, Mossman & Sriram, P.C.

(57) ABSTRACT

A downhole device processes particles entrained in a drilling fluid returning up a wellbore. In one embodiment, the device includes a housing having at least one cutting surface formed in a chamber of a housing. A cutting head disposed in the chamber crushes or comminutes the particles entrained in the drilling fluid to a predetermined size. The device is disposed in the wellbore and processes the entrained particles before they enter a selected wellbore device such as a pump. In certain embodiments, the housing has at least two chambers, wherein the entrained particles are reduced to a first predetermined size in the first chamber, a second predetermined size in the second chamber, etc. Also, the housing can include an operator that generates an energy field that reduces the size of the particles entrained in the drilling fluid to a first predetermined size when the particles flow through the energy field.

34 Claims, 11 Drawing Sheets

U.S. PATENT DOCUMENTS

| | | | | |
|---|---|---|---|---|
| 4,137,975 | A | 2/1979 | Pennock | |
| 4,149,603 | A | 4/1979 | Arnold | |
| 4,210,208 | A | 7/1980 | Shanks | |
| 4,223,747 | A | 9/1980 | Marais | |
| 4,240,513 | A | 12/1980 | Castel et al. | |
| 4,291,772 | A | 9/1981 | Beynet | |
| 4,368,787 | A | 1/1983 | Messenger | |
| 4,436,166 | A | 3/1984 | Hayatdavoudi et al. | |
| 4,440,239 | A | 4/1984 | Evans | |
| 4,534,426 | A | 8/1985 | Hooper | |
| 4,613,003 | A | 9/1986 | Ruhle | |
| 4,630,691 | A | 12/1986 | Hooper | |
| 4,744,426 | A | 5/1988 | Reed | |
| 4,813,495 | A | 3/1989 | Leach | |
| 5,150,757 | A | 9/1992 | Nunley | |
| 5,168,932 | A | 12/1992 | Worrall et al. | |
| 5,355,967 | A | 10/1994 | Mueller et al. | |
| 5,651,420 | A | 7/1997 | Tibbitts et al. | |
| 5,775,443 | A | 7/1998 | Lott | |
| 6,045,070 | A * | 4/2000 | Davenport | 241/60 |
| 6,142,236 | A | 11/2000 | Brammer et al. | |
| 6,176,311 | B1 * | 1/2001 | Ryan | 166/99 |
| 6,216,799 | B1 | 4/2001 | Gonzalez | |
| 6,276,455 | B1 | 8/2001 | Gonzalez | |
| 6,374,925 | B1 | 4/2002 | Elkins et al. | 175/25 |
| 6,415,877 | B1 | 7/2002 | Fincher et al. | |

FOREIGN PATENT DOCUMENTS

| | | |
|---|---|---|
| EP | 0290250 | 9/1988 |

OTHER PUBLICATIONS

*Technologies Manage Well Pressures*, Don M. Hannegan, Ron Divine, The American Oil & Gas Reporter, Sep., 2001.

*Continuous Circulation Drilling*, L. J. Ayling, Maris Int'l Ltd.; J. W. Jenner, Maris Int'l Ltd., H. Elkins, Varco Drilling Dquipment, this paper prepared for presentation at the 2002 Offshore Technology Confrence, Houston, Texas May 6-9, 2002.

* cited by examiner

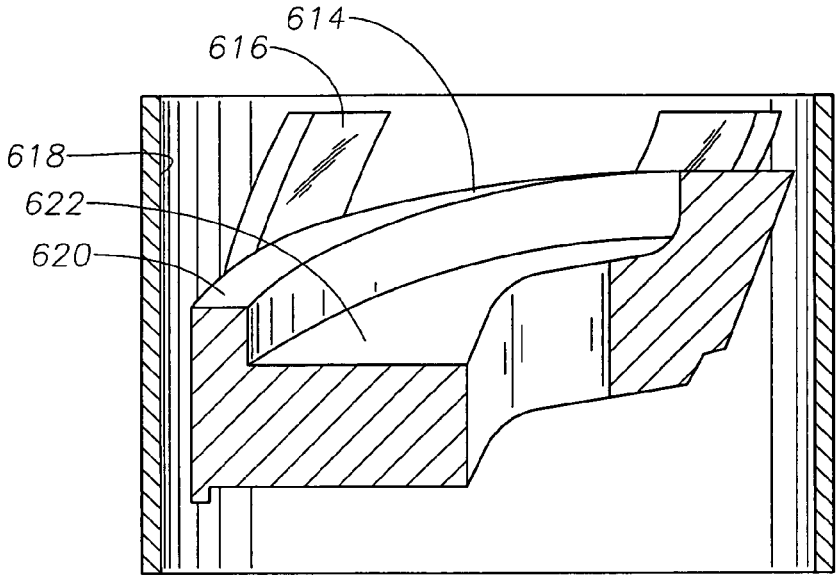
Fig. 8
Fig. 9
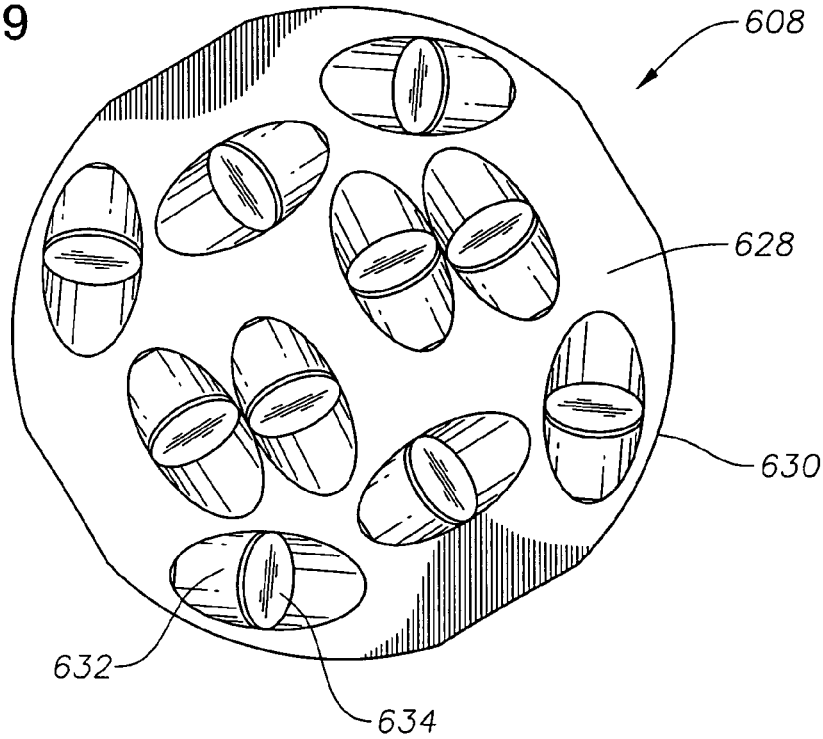

DOWNHOLE CUTTING MILL

CROSS-REFERENCE TO RELATED APPLICATIONS

This application is a continuation-in-part of U.S. patent application Ser. No. 10/251,138 filed Sep. 20, 2002, now abandoned, which takes priority from U.S. provisional patent application Ser. No. 60/323,803 filed on Sep. 20, 2001, titled "Active Controlled Bottomhole Pressure System and Method."

FIELD OF THE INVENTION

This invention relates generally to oilfield wellbore drilling systems and more particularly to drilling systems that utilize active control of bottomhole pressure or equivalent circulating density during drilling of the wellbores.

BACKGROUND OF THE ART

Oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. The drill pipe is made of jointed pipes. Alternatively, coiled tubing may be utilized to carry the drilling of assembly. The drilling assembly usually includes a drilling motor or a "mud motor" that rotates the drill bit. The drilling assembly also includes a variety of sensors for taking measurements of a variety of drilling, formation and BHA parameters. A suitable drilling fluid (commonly referred to as the "mud") is supplied or pumped under pressure from a source at the surface down the tubing. The drilling fluid drives the mud motor and then discharges at the bottom of the drill bit. The drilling fluid returns uphole via the annulus between the drill string and the wellbore inside and carries with it pieces of formation (commonly referred to as the "cuttings") cut or produced by the drill bit in drilling the wellbore.

For drilling wellbores under water (referred to in the industry as "offshore" or "subsea" drilling) tubing is provided at a work station (located on a vessel or platform). One or more tubing injectors or rigs are used to move the tubing into and out of the wellbore. In riser-type drilling, a riser, which is formed by joining sections of casing or pipe, is deployed between the drilling vessel and the wellhead equipment at the sea bottom and is utilized to guide the tubing to the wellhead. The riser also serves as a conduit for fluid returning from the wellhead to the sea surface.

During drilling, the drilling operator attempts to carefully control the fluid density at the surface so as to control pressure in the wellbore, including the bottomhole pressure. Typically, the operator maintains the hydrostatic pressure of the drilling fluid in the wellbore above the formation or pore pressure to avoid well blow-out. The density of the drilling fluid and the fluid flow rate largely determine the effectiveness of the drilling fluid to carry the cuttings to the surface. One important downhole parameter controlled during drilling is the bottomhole pressure, which in turn controls the equivalent circulating density ("ECD") of the fluid at the wellbore bottom.

This term, ECD, describes the condition that exists when the drilling mud in the well is circulated. The friction pressure caused by the fluid circulating through the open hole and the casing(s) on its way back to the surface, causes an increase in the pressure profile along this path that is different from the pressure profile when the well is in a static condition (i.e., not circulating). In addition to the increase in pressure while circulating, there is an additional increase in pressure while drilling due to the introduction of drill solids into the fluid. This negative effect of the increase in pressure along the annulus of the well is an increase of the pressure which can fracture the formation at the shoe of the last casing. This can reduce the amount of hole that can be drilled before having to set an additional casing. In addition, the rate of circulation that can be achieved is also limited. Also, due to this circulating pressure increase, the ability to clean the hole is severely restricted. This condition is exacerbated when drilling an offshore well. In offshore wells, the difference between the fracture pressures in the shallow sections of the well and the pore pressures of the deeper sections is considerably smaller compared to on shore wellbores. This is due to the seawater gradient versus the gradient that would exist if there were soil overburden for the same depth.

In some drilling applications, it is desired to drill the wellbore at at-balance condition or at under-balanced condition. The term at-balance means that the pressure in the wellbore is maintained at or near the formation pressure. The under-balanced condition means that the wellbore pressure is below the formation pressure. These two conditions are desirable because the drilling fluid under such conditions does not penetrate into the formation, thereby leaving the formation virgin for performing formation evaluation tests and measurements. In order to be able to drill a well to a total wellbore depth at the bottomhole, ECD must be reduced or controlled. In subsea wells, one approach is to use a mud-filled riser to form a subsea fluid circulation system utilizing the tubing, BHA, the annulus between the tubing and the wellbore and the mud filled riser, and then inject gas (or some other low density liquid) in the primary drilling fluid (typically in the annulus adjacent the BHA) to reduce the density of fluid downstream (i.e., in the remainder of the fluid circulation system). This so-called "dual density" approach is often referred to as drilling with compressible fluids.

Another method for changing the density gradient in a deepwater return fluid path has been proposed, but not used in practical application. This approach proposes to use a tank, such as an elastic bag, at the sea floor for receiving return fluid from the wellbore annulus and holding it at the hydrostatic pressure of the water at the sea floor. Independent of the flow in the annulus, a separate return line connected to the sea floor storage tank and a subsea lifting pump delivers the return fluid to the surface. Although this technique (which is referred to as "dual gradient" drilling) would use a single fluid, it would also require a discontinuity in the hydraulic gradient line between the sea floor storage tank and the subsea lifting pump. This requires close monitoring and control of the pressure at the subsea storage tank, subsea hydrostatic water pressure, subsea lifting pump operation and the surface pump delivering drilling fluids under pressure into the tubing for flow downhole. The level of complexity of the required subsea instrumentation and controls as well as the difficulty of deployment of the system has delayed (if not altogether prevented) the practical application of the "dual gradient" system.

Another approach is described in U.S. patent application Ser. No. 09/353,275, filed on Jul. 14, 1999 and assigned to the assignee of the present application. The U.S. patent application Ser. No. 09/353,275 is incorporated herein by reference in its entirety. One embodiment of this application describes a riser less system wherein a centrifugal pump in a separate return line controls the fluid flow to the surface and thus the equivalent circulating density.

The present invention provides a wellbore system wherein the bottomhole pressure and hence the equivalent circulating density is controlled by creating a pressure differential at a selected location in the return fluid path with an active pressure differential device to reduce or control the bottomhole pressure. The present system is relatively easy to incorporate in new and existing systems.

SUMMARY OF THE INVENTION

The present invention provides wellbore systems for performing downhole wellbore operations for both land and offshore wellbores. Such drilling systems include a rig that moves an umbilical (e.g., drill string) into and out of the wellbore. A bottomhole assembly, carrying the drill bit, is attached to the bottom end of the drill string. A well control assembly or equipment on the well receives the bottomhole assembly and the tubing. A drilling fluid system supplies a drilling fluid into the tubing, which discharges at the drill bit and returns to the well control equipment carrying the drill cuttings via the annulus between the drill string and the wellbore. A riser dispersed between the wellhead equipment and the surface guides the drill string and provides a conduit for moving the returning fluid to the surface.

In one embodiment of the present invention, an active pressure differential device moves in the wellbore as the drill string is moved. In an alternative embodiment, the active differential pressure device is attached to the wellbore inside or wall and remains stationary relative to the wellbore during drilling. The device is operated during drilling, i.e., when the drilling fluid is circulating through the wellbore, to create a pressure differential across the device. This pressure differential alters the pressure on the wellbore below or downhole of the device. The device may be controlled to reduce the bottomhole pressure by a certain amount, to maintain the bottomhole pressure at a certain value, or within a certain range. By severing or restricting the flow through the device, the bottomhole pressure may be increased.

The system also includes downhole devices for performing a variety of functions. Exemplary downhole devices include devices that control the drilling flow rate and flow paths. For example, the system can include one or more flow-control devices that can stop the flow of the fluid in the drill string and/or the annulus. Such flow-control devices can be configured to direct fluid in drill string into the annulus and/or bypass return fluid around the APD device. Another exemplary downhole device can be configured for processing the cuttings (e.g., reduction of cutting size) and other debris flowing in the annulus. For example, a comminution device can be disposed in the annulus upstream of the APD device.

In a preferred embodiment, sensors communicate with a controller via a telemetry system to maintain the wellbore pressure at a zone of interest at a selected pressure or range of pressures. The sensors are strategically positioned throughout the system to provide information or data relating to one or more selected parameters of interest such as drilling parameters, drilling assembly or BHA parameters, and formation or formation evaluation parameters. The controller for suitable for drilling operations preferably includes programs for maintaining the wellbore pressure at zone at under-balance condition, at at-balance condition or at over-balanced condition. The controller may be programmed to activate downhole devices according to programmed instructions or upon the occurrence of a particular condition.

Exemplary configurations for the APD Device and associated drive includes a moineau-type pump coupled to positive displacement motor/drive via a shaft assembly. Another exemplary configuration includes a turbine drive coupled to a centrifugal-type pump via a shaft assembly. Preferably, a high-pressure seal separates a supply fluid flowing through the motor from a return fluid flowing through the pump. In a preferred embodiment, the seal is configured to bear either or both of radial and axial (thrust) forces.

In still other configurations, a positive displacement motor can drive an intermediate device such as a hydraulic motor, which drives the APD Device. Alternatively, a jet pump can be used, which can eliminate the need for a drive/motor. Moreover, pumps incorporating one or more pistons, such as hammer pumps, may also be suitable for certain applications. In still other configurations, the APD Device can be driven by an electric motor. The electric motor can be positioned external to a drill string or formed integral with a drill string. In a preferred arrangement, varying the speed of the electrical motor directly controls the speed of the rotor in the APD device, and thus the pressure differential across the APD Device.

Bypass devices are provided to allow fluid circulation in the wellbore during tripping of the system, to control the operating set points of the APD Device and/or associated drive/motor, and to provide a discharge mechanism to relieve fluid pressure. For examples, the bypass devices can selectively channel fluid around the motor/drive and the APD Device and selectively discharge drilling fluid from the drill string into the annulus. In one arrangement, the bypass device for the pump can also function as a particle bypass line for the APD device. Alternatively, a separate particle bypass can be used in addition to the pump bypass for such a function. Additionally, an annular seal (not shown) in certain embodiments can be disposed around the APD device to enable a pressure differential across the APD Device.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawing:

FIG. 8 schematically illustrates an exemplary non rotating chamber part for the FIG. 7 embodiment;

FIG. 9 schematically illustrates an exemplary cutting head for the FIG. 7 embodiment;

DETAILED DESCRIPTION OF PREFERRED EMBODIMENTS

Figure 1A:
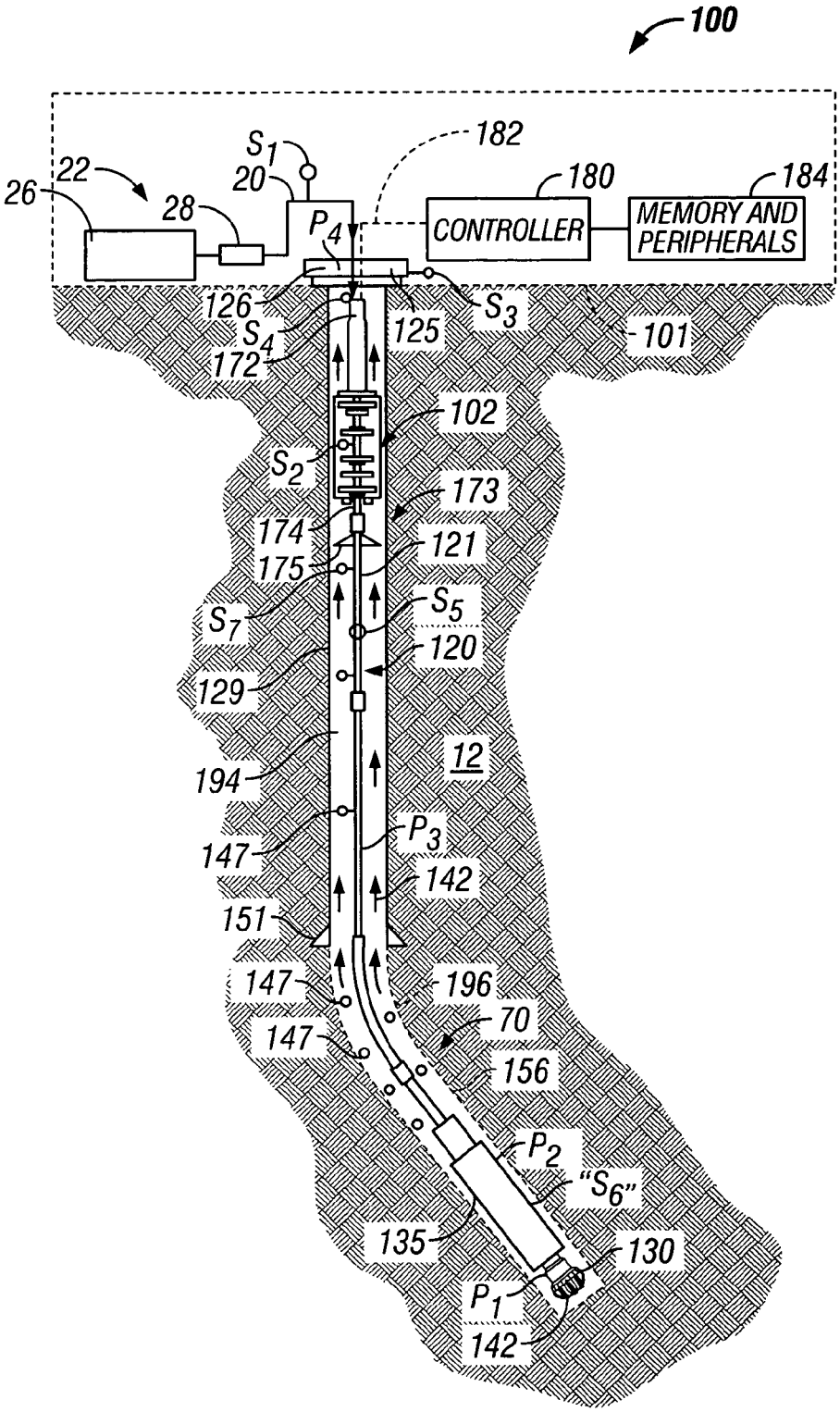
FIG. 1A is a schematic illustration of one embodiment of a system using an active pressure differential device to manage pressure in a predetermined wellbore location.

Referring initially to FIG. 1A, there is schematically illustrated a system for performing one or more operations related to the construction, logging, completion or workover of a hydrocarbon producing well. In particular, FIG. 1A shows a schematic elevation view of one embodiment of a wellbore drilling system 100 for drilling wellbore 90 using conventional drilling fluid circulation. The drilling system 100 is a rig for land wells and includes a drilling platform 101, which may be a drill ship or another suitable surface workstation such as a floating platform or a semi-submersible for offshore wells. For offshore operations, additional known equipment such as a riser and subsea wellhead will typically be used. To drill a wellbore 90, well control equipment 125 (also referred to as the wellhead equipment) is placed above the wellbore 90. The wellhead equipment 125 includes a blow-out-preventer stack 126 and a lubricator (not shown) with its associated flow control.

This system 100 further includes a well tool such as a drilling assembly or a bottomhole assembly ("BHA") 135 at the bottom of a suitable umbilical such as drill string or tubing 121 (such terms will be used interchangeably). In a preferred embodiment, the BHA 135 includes a drill bit 130 adapted to disintegrate rock and earth. The bit can be rotated by a surface rotary drive or a motor using pressurized fluid (e.g., mud motor) or an electrically driven motor. The tubing 121 can be formed partially or fully of drill pipe, metal or composite coiled tubing, liner, casing or other known members. Additionally, the tubing 121 can include data and power transmission carriers such fluid conduits, fiber optics, and metal conductors. Conventionally, the tubing 121 is placed at the drilling platform 101. To drill the wellbore 90, the BHA 135 is conveyed from the drilling platform 101 to the wellhead equipment 125 and then inserted into the wellbore 90. The tubing 121 is moved into and out of the wellbore 90 by a suitable tubing injection system.

During drilling, a drilling fluid from a surface mud system 22 is pumped under pressure down the tubing 121 (a "supply fluid"). The mud system 22 includes a mud pit or supply source 26 and one or more pumps 28. In one embodiment, the supply fluid operates a mud motor in the BHA 135, which in turn rotates the drill bit 130. The drill string 121 rotation can also be used to rotate the drill bit 130, either in conjunction with or separately from the mud motor. The drill bit 130 disintegrates the formation (rock) into cuttings 147. The drilling fluid leaving the drill bit travels uphole through the annulus 194 between the drill string 121 and the wellbore wall or inside 196, carrying the drill cuttings 147 therewith (a "return fluid"). The return fluid discharges into a separator (not shown) that separates the cuttings 147 and other solids from the return fluid and discharges the clean fluid back into the mud pit 26. As shown in FIG. 1A, the clean mud is pumped through the tubing 121 while the mud with cuttings 147 returns to the surface via the annulus 194 up to the wellhead equipment 125.

Once the well 90 has been drilled to a certain depth, casing 129 with a casing shoe 151 at the bottom is installed. The drilling is then continued to drill the well to a desired depth that will include one or more production sections, such as section 155. The section below the casing shoe 151 may not be cased until it is desired to complete the well, which leaves the bottom section of the well as an open hole, as shown by numeral 156.

As noted above, the present invention provides a drilling system for controlling bottomhole pressure at a zone of interest designated by the numeral 155 and thereby the ECD effect on the wellbore. In one embodiment of the present invention, to manage or control the pressure at the zone 155, an active pressure differential device ("APD Device") 170 is fluidicly coupled to return fluid downstream of the zone of interest 155. The active pressure differential device is a device that is capable of creating a pressure differential "ΔP" across the device. This controlled pressure drop reduces the pressure upstream of the APD Device 170 and particularly in zone 155.

The system 100 also includes downhole devices that separately or cooperatively perform one or more functions such as controlling the flow rate of the drilling fluid and controlling the flow paths of the drilling fluid. For example, the system 100 can include one or more flow-control devices that can stop the flow of the fluid in the drill string and/or the annulus 194. FIG. 1A shows an exemplary flow-control device 173 that includes a device 174 that can block the fluid flow within the drill string 121 and a device 175 that blocks can block fluid flow through the annulus 194. The device 173 can be activated when a particular condition occurs to insulate the well above and below the flow-control device 173. For example, the flow-control device 173 may be activated to block fluid flow communication when drilling fluid circulation is stopped so as to isolate the sections above and below the device 173, thereby maintaining the wellbore below the device 173 at or substantially at the pressure condition prior to the stopping of the fluid circulation.

The flow-control devices 174, 175 can also be configured to selectively control the flow path of the drilling fluid. For example, the flow-control device 174 in the drill pipe 121 can be configured to direct some or all of the fluid in drill string 121 into the annulus 194. Moreover, one or both of the flow-control devices 174, 175 can be configured to bypass some or all of the return fluid around the APD device 170. Such an arrangement may be useful, for instance, to assist in lifting cuttings to the surface. The flow-control device 173 may include check-valves, packers and any other suitable device. Such devices may automatically activate upon the occurrence of a particular event or condition.

The system 100 also includes downhole devices for processing the cuttings (e.g., reduction of cutting size) and other debris flowing in the annulus 194. For example, a comminution device 176 can be disposed in the annulus 194 upstream of the APD device 170 to reduce the size of entrained cutting and other debris. The comminution device 176 can use known members such as blades, teeth, or rollers to crush, pulverize or otherwise disintegrate cuttings and debris entrained in the fluid flowing in the annulus 194. The comminution device 176 can be operated by an electric motor, a hydraulic motor, by rotation of drill string or other suitable means. The comminution device 176 can also be integrated into the APD device 170. For instance, if a multi-stage turbine is used as the APD device 170, then the stages adjacent the inlet to the turbine can be replaced with blades adapted to cut or shear particles before they pass through the blades of the remaining turbine stages.

Sensors $S_{1-n}$ are strategically positioned throughout the system 100 to provide information or data relating to one or more selected parameters of interest (pressure, flow rate, temperature). In a preferred embodiment, the downhole devices and sensors $S_{1-n}$ communicate with a controller 180 via a telemetry system (not shown). Using data provided by the sensors $S_{1-n}$, the controller 180 maintains the wellbore pressure at zone 155 at a selected pressure or range of pressures. The controller 180 maintains the selected pressure by controlling the APD device 170 (e.g., adjusting amount of energy added to the return fluid line) and/or the downhole devices (e.g., adjusting flow rate through a restriction such as a valve).

When configured for drilling operations, the sensors $S_{1-n}$ provide measurements relating to a variety of drilling parameters, such as fluid pressure, fluid flow rate, rotational speed of pumps and like devices, temperature, weight-on bit, rate of penetration, etc., drilling assembly or BHA parameters, such as vibration, stick slip, RPM, inclination, direction, BHA location, etc. and formation or formation evaluation parameters commonly referred to as measurement-while-drilling parameters such as resistivity, acoustic, nuclear, NMR, etc. One preferred type of sensor is a pressure sensor for measuring pressure at one or more locations. Referring still to FIG. 1A, pressure sensor $P_1$ provides pressure data in the BHA, sensor $P_2$ provides pressure data in the annulus, pressure sensor $P_3$ in the supply fluid, and pressure sensor $P_4$ provides pressure data at the surface. Other pressure sensors may be used to provide pressure data at any other desired place in the system 100. Additionally, the system 100 includes fluid flow sensors such as sensor V that provides measurement of fluid flow at one or more places in the system.

Further, the status and condition of equipment as well as parameters relating to ambient conditions (e.g., pressure and other parameters listed above) in the system 100 can be monitored by sensors positioned throughout the system 100: exemplary locations including at the surface (S1), at the APD device 170 (S2), at the wellhead equipment 125 (S3), in the supply fluid (S4), along the tubing 121 (S5), at the well tool 135 (S6), in the return fluid upstream of the APD device 170 (S7), and in the return fluid downstream of the APD device 170 (S8). It should be understood that other locations may also be used for the sensors $S_{1-n}$.

The controller 180 for suitable for drilling operations preferably includes programs for maintaining the wellbore pressure at zone 155 at under-balance condition, at at-balance condition or at over-balanced condition. The controller 180 includes one or more processors that process signals from the various sensors in the drilling assembly and also controls their operation. The data provided by these sensors $S_{1-n}$ and control signals transmitted by the controller 180 to control downhole devices such as devices 173–176 are communicated by a suitable two-way telemetry system (not shown). A separate processor may be used for each sensor or device. Each sensor may also have additional circuitry for its unique operations. The controller 180, which may be either downhole or at the surface, is used herein in the generic sense for simplicity and ease of understanding and not as a limitation because the use and operation of such controllers is known in the art. The controller 180 preferably contains one or more microprocessors or micro-controllers for processing signals and data and for performing control functions, solid state memory units for storing programmed instructions, models (which may be interactive models) and data, and other necessary control circuits. The microprocessors control the operations of the various sensors, provide communication among the downhole sensors and provide two-way data and signal communication between the drilling assembly 30, downhole devices such as devices 173–175 and the surface equipment via the two-way telemetry. In other embodiments, the controller 180 can be a hydro-mechanical device that incorporates known mechanisms (valves, biased members, linkages cooperating to actuate tools under, for example, preset conditions).

For convenience, a single controller 180 is shown. It should be understood, however, that a plurality of controllers 180 can also be used. For example, a downhole controller can be used to collect, process and transmit data to a surface controller, which further processes the data and transmits appropriate control signals downhole. Other variations for dividing data processing tasks and generating control signals can also be used.

In general, however, during operation, the controller 180 receives the information regarding a parameter of interest and adjusts one or more downhole devices and/or APD device 170 to provide the desired pressure or range or pressure in the vicinity of the zone of interest 155. For example, the controller 180 can receive pressure information from one or more of the sensors ($S_1$–$S_n$) in the system 100. The controller 180 may control the APD Device 170 in response to one or more of: pressure, fluid flow, a formation characteristic, a wellbore characteristic and a fluid characteristic, a surface measured parameter or a parameter measured in the drill string. The controller 180 determines the ECD and adjusts the energy input to the APD device 170 to maintain the ECD at a desired or predetermined value or within a desired or predetermined range. The wellbore system 100 thus provides a closed loop system for controlling the ECD in response to one or more parameters of interest during drilling of a wellbore. This system is relatively simple and efficient and can be incorporated into new or existing drilling systems and readily adapted to support other well construction, completion, and work-over activities.

In the embodiment shown in FIG. 1A, the APD Device 170 is shown as a turbine attached to the drill string 121 that operates within the annulus 194. Other embodiments, described in further detail below can include centrifugal pumps, positive displacement pump, jet pumps and other like devices. During drilling, the APD Device 170 moves in the wellbore 90 along with the drill string 121. The return fluid can flow through the APD Device 170 whether or not the turbine is operating. However, the APD Device 170, when operated creates a differential pressure thereacross.

As described above, the system 100 in one embodiment includes a controller 180 that includes a memory and peripherals 184 for controlling the operation of the APD Device 170, the devices 173–176, and/or the bottomhole assembly 135. In FIG. 1A, the controller 180 is shown placed at the surface. It, however, may be located adjacent the APD Device 170, in the BHA 135 or at any other suitable location. The controller 180 controls the APD Device to create a desired amount of ΔP across the device, which alters the bottomhole pressure accordingly. Alternatively, the controller 180 may be programmed to activate the flow-control device 173 (or other downhole devices) according to programmed instructions or upon the occurrence of a particular condition. Thus, the controller 180 can control the APD Device in response to sensor data regarding a parameter of interest, according to programmed instructions provided to said APD Device, or in response to instructions provided to said APD Device from a remote location. The controller 180 can, thus, operate autonomously or interactively.

During drilling, the controller 180 controls the operation of the APD Device to create a certain pressure differential across the device so as to alter the pressure on the formation or the bottomhole pressure. The controller 180 may be programmed to maintain the wellbore pressure at a value or range of values that provide an under-balance condition, an at-balance condition or an over-balanced condition. In one embodiment, the differential pressure may be altered by altering the speed of the APD Device. For instance, the bottomhole pressure may be maintained at a preselected value or within a selected range relative to a parameter of interest such as the formation pressure. The controller 180 may receive signals from one or more sensors in the system 100 and in response thereto control the operation of the APD Device to create the desired pressure differential. The controller 180 may contain pre-programmed instructions and autonomously control the APD Device or respond to signals received from another device that may be remotely located from the APD Device.

Figure 1B:
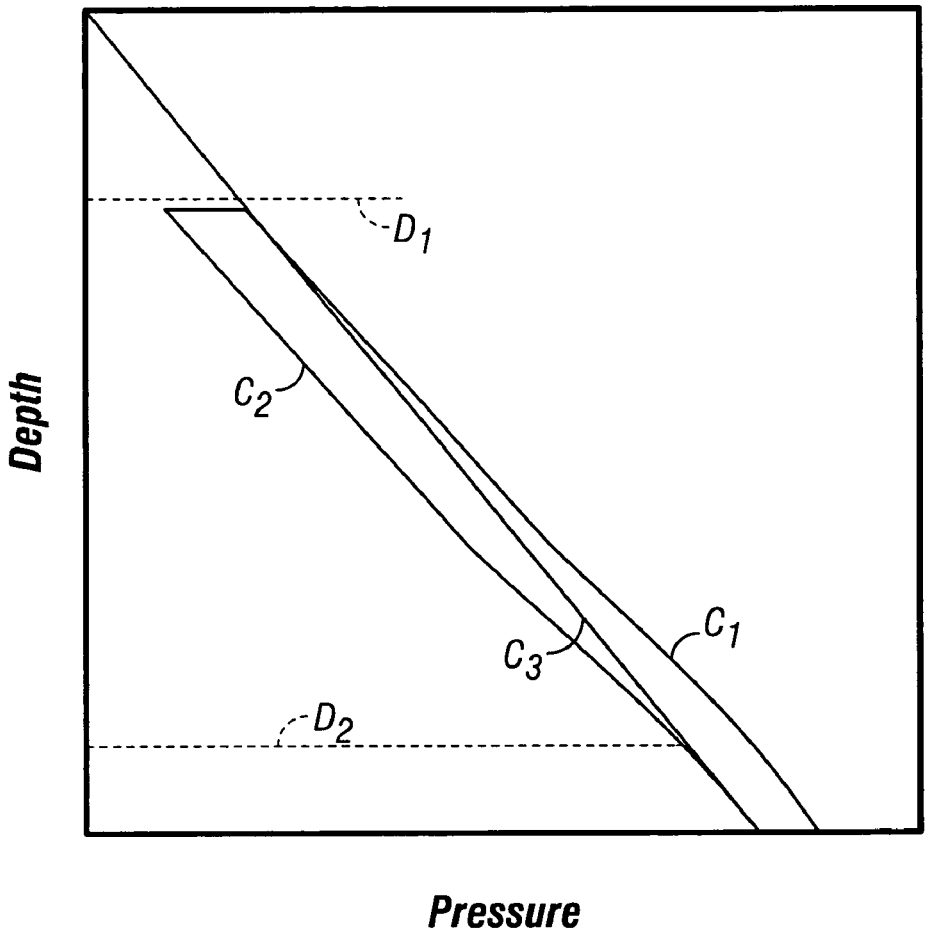
FIG. 1B graphically illustrates the effect of an operating active pressure differential device upon the pressure at a predetermined wellbore location.

FIG. 1B graphically illustrates the ECD control provided by the above-described embodiment of the present invention and references FIG. 1A for convenience. FIG. 1A shows the APD device 170 at a depth D1 and a representative location in the wellbore in the vicinity of the well tool 30 at a lower depth D2. FIG. 1B provides a depth versus pressure graph having a first curve C1 representative of a pressure gradient before operation of the system 100 and a second curve C2 representative of a pressure gradients during operation of the system 100. Curve C3 represents a theoretical curve wherein the ECD condition is not present; i.e., when the well is static and not circulating and is free of drill cuttings. It will be seen that a target or selected pressure at depth D2 under curve C3 cannot be met with curve C1. Advantageously, the system 100 reduces the hydrostatic pressure at depth D1 and thus shifts the pressure gradient as shown by curve C3, which can provide the desired predetermined pressure at depth D2. In most instances, this shift is roughly the pressure drop provided by the APD device 170.

Figure 2:
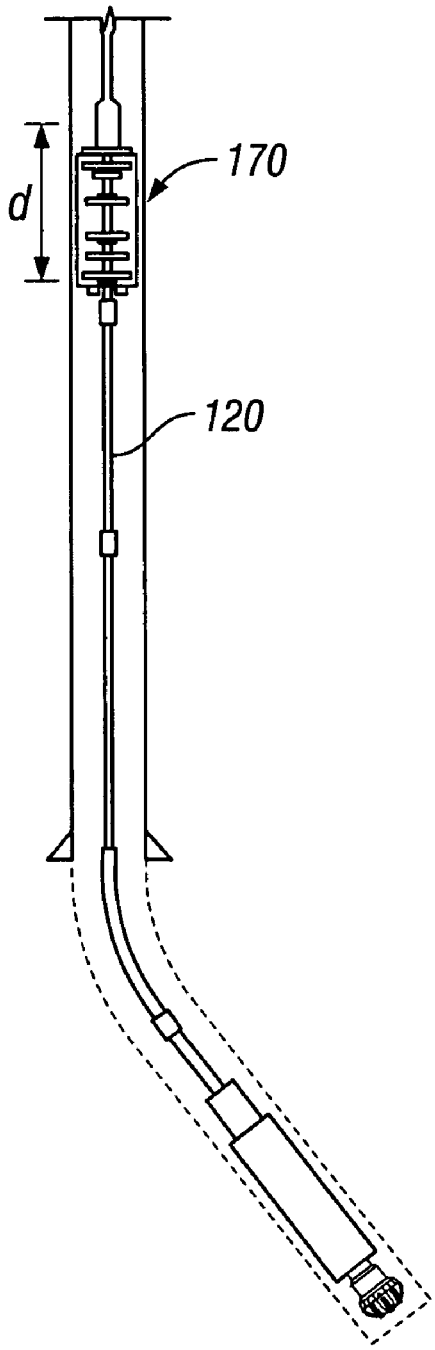
FIG. 2 is a schematic elevation view of FIG. 1A after the drill string and the active pressure differential device have moved a certain distance in the earth formation from the location shown in FIG. 1A.

FIG. 2 shows the drill string after it has moved the distance "d" shown by $t_1$–$t_2$. Since the APD Device 170 is attached to the drill string 121, the APD Device 170 also is shown moved by the distance d.

Figure 3:
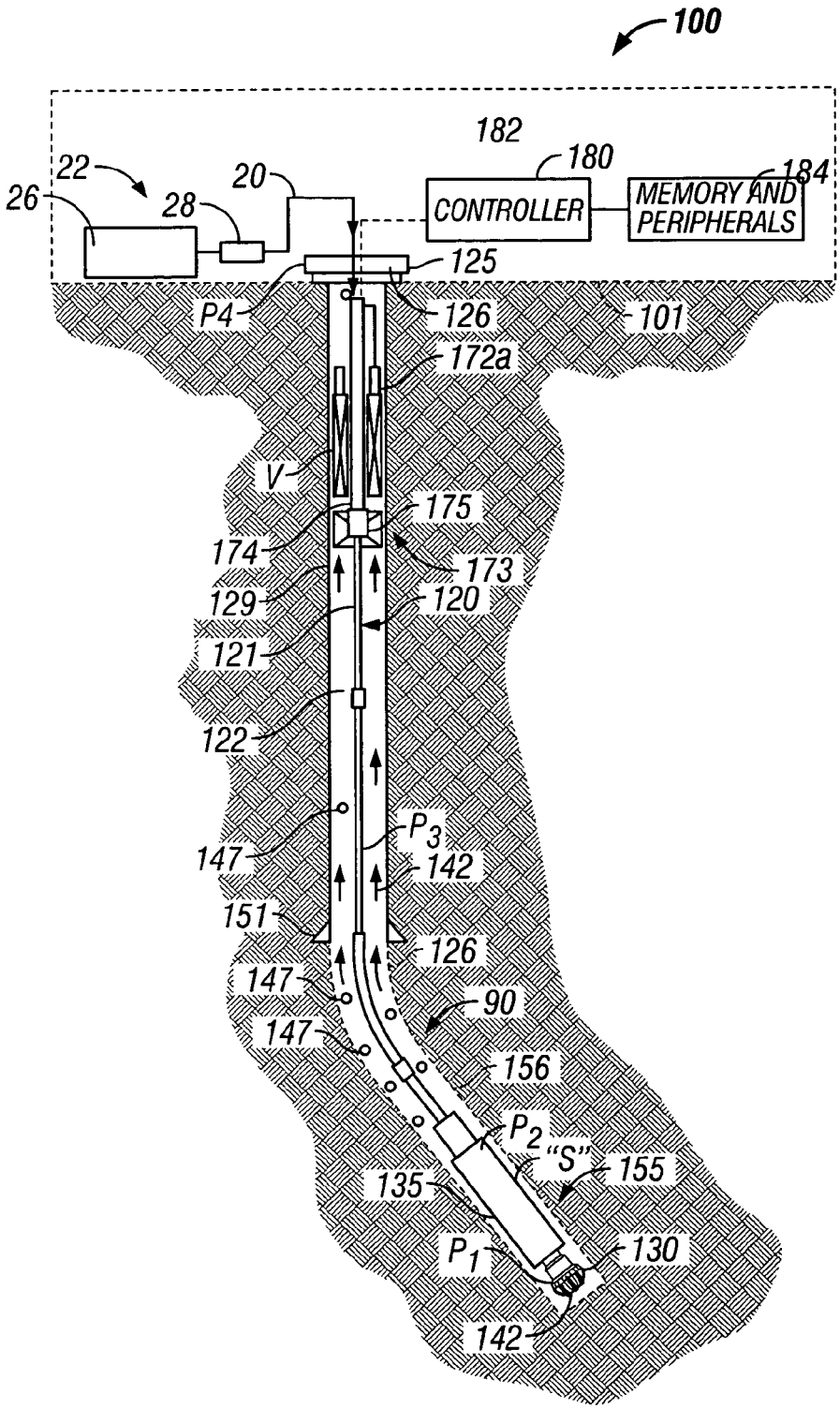
FIG. 3 is a schematic elevation view of an alternative embodiment of the wellbore system wherein the active pressure differential device is attached to the wellbore inside.
Figure 4A:
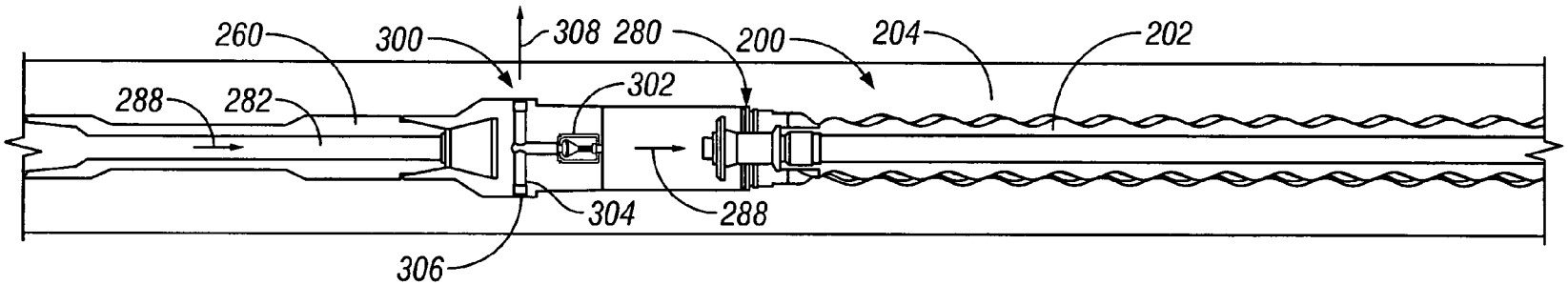
FIGS. 4A–D are schematic illustrations of one embodiment of an arrangement according to the present invention wherein a positive displacement motor is coupled to a positive displacement pump (the APD Device)
Figure 4B:
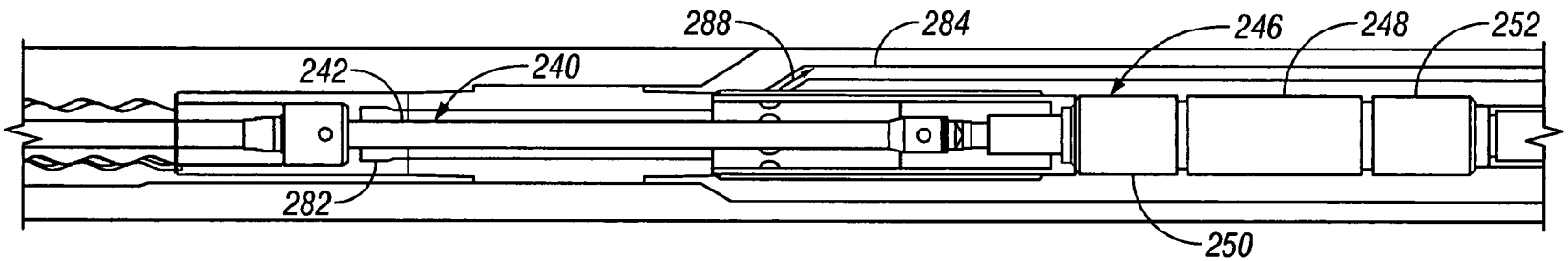
Figure 4C:
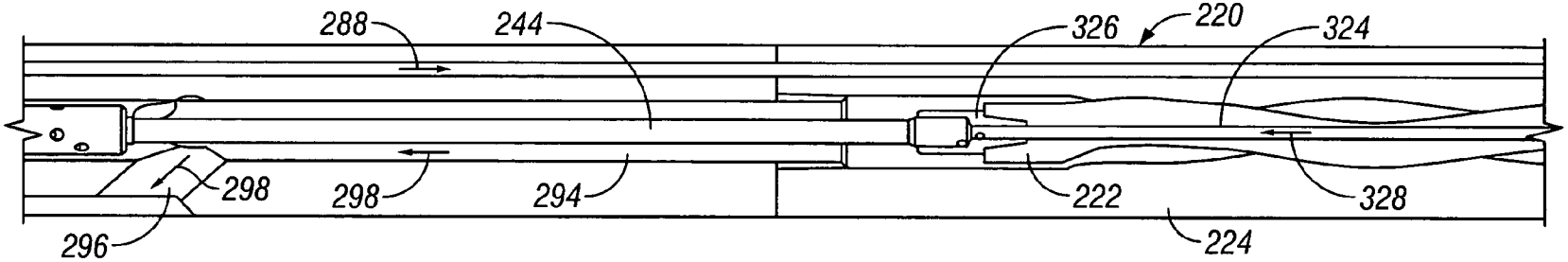
Figure 4D:
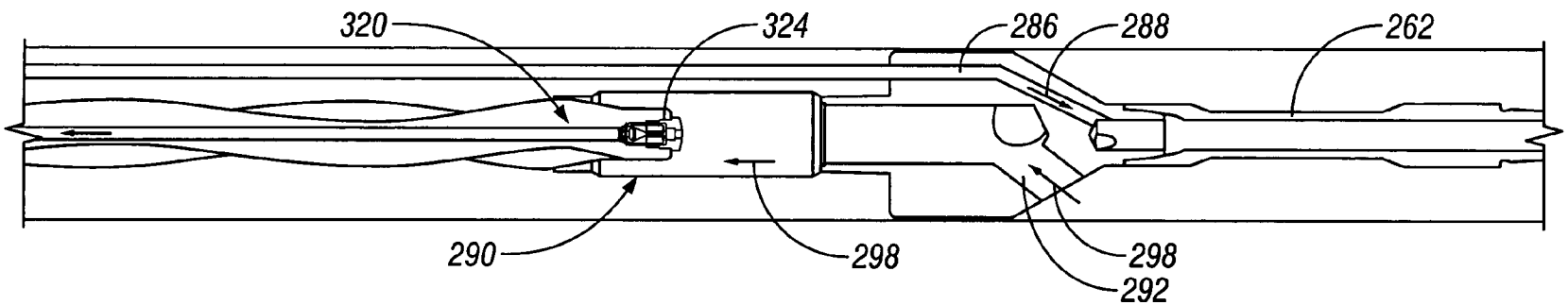

As noted earlier and shown in FIG. 2, an APD Device 170*a* may be attached to the wellbore in a manner that will allow the drill string 121 to move while the APD Device 170*a* remains at a fixed location. FIG. 3 shows an embodiment wherein the APD Device is attached to the wellbore inside and is operated by a suitable device 172*a*. Thus, the APD device can be attached to a location stationary relative to said drill string such as a casing, a liner, the wellbore annulus, a riser, or other suitable wellbore equipment. The APD Device 170*a* is preferably installed so that it is in a cased upper section 129. The device 170*a* is controlled in the manner described with respect to the device 170 (FIG. 1A).

Referring now to FIGS. 4A–D, there is schematically illustrated one arrangement wherein a positive displacement motor/drive 200 is coupled to a moineau-type pump 220 via a shaft assembly 240. The motor 200 is connected to an upper string section 260 through which drilling fluid is pumped from a surface location. The pump 220 is connected to a lower drill string section 262 on which the bottomhole assembly (not shown) is attached at an end thereof. The motor 200 includes a rotor 202 and a stator 204. Similarly, the pump 220 includes a rotor 222 and a stator 224. The design of moineau-type pumps and motors are known to one skilled in the art and will not be discussed in further detail.

The shaft assembly 240 transmits the power generated by the motor 200 to the pump 220. One preferred shaft assembly 240 includes a motor flex shaft 242 connected to the motor rotor 202, a pump flex shaft 244 connected to the pump rotor 224, and a coupling shaft 246 for joining the first and second shafts 242 and 244. In one arrangement, a high-pressure seal 248 is disposed about the coupling shaft 246. As is known, the rotors for moineau-type motors/pump are subject to eccentric motion during rotation. Accordingly, the coupling shaft 246 is preferably articulated or formed sufficiently flexible to absorb this eccentric motion. Alternately or in combination, the shafts 242, 244 can be configured to flex to accommodate eccentric motion. Radial and axial forces can be borne by bearings 250 positioned along the shaft assembly 240. In a preferred embodiment, the seal 248 is configured to bear either or both of radial and axial (thrust) forces. In certain arrangements, a speed or torque converter 252 can be used to convert speed/torque of the motor 200 to a second speed/torque for the pump 220. By speed/torque converter it is meant known devices such as variable or fixed ratio mechanical gearboxes, hydrostatic torque converters, and a hydrodynamic converters. It should be understood that any number of arrangements and devices can be used to transfer power, speed, or torque from the motor 200 to the pump 220. For example, the shaft assembly 240 can utilize a single shaft instead of multiple shafts.

As described earlier, a comminution device can be used to process entrained cutting in the return fluid before it enters the pump 200. Such a comminution device (FIG. 1A) can be coupled to the drive 200 or pump 220 and operated thereby. For instance, one such comminution device or cutting mill 270 can include a shaft 272 coupled to the pump rotor 224. The shaft 272 can include a conical head or hammer element 274 mounted thereon. During rotation, the eccentric motion of the pump rotor 224 will cause a corresponding radial motion of the shaft head 274. This radial motion can be used to resize the cuttings between the rotor and a comminution device housing 276.

The FIGS. 4A–D arrangement also includes a supply flow path 290 to carry supply fluid from the device 200 to the lower drill string section 262 and a return flow path 292 to channel return fluid from the casing interior or annulus into and out of the pump 220. The high pressure seal 248 is interposed between the flow paths 290 and 292 to prevent fluid leaks, particularly from the high pressure fluid in the supply flow path 290 into the return flow path 292. The seal 248 can be a high-pressure seal, a hydrodynamic seal or other suitable seal and formed of rubber, an elastomer, metal or composite.

Additionally, bypass devices are provided to allow fluid circulation during tripping of the downhole devices of the system 100 (FIG. 1A), to control the operating set points of the motor 200 and pump 220, and to provide safety pressure relief along either or both of the supply flow path 290 and the return flow path 292. Exemplary bypass devices include a circulation bypass 300, motor bypass 310, and a pump bypass 320.

The circulation bypass 300 selectively diverts supply fluid into the annulus 194 (FIG. 1A) or casing C interior. The circulation bypass 300 is interposed generally between the upper drill string section 260 and the motor 200. One preferred circulation bypass 300 includes a biased valve member 302 that opens when the flow-rate drops below a predetermined valve. When the valve 302 is open, the supply fluid flows along a channel 304 and exits at ports 306. More generally, the circulation bypass can be configured to actuate upon receiving an actuating signal and/or detecting a predetermined value or range of values relating to a parameter of interest (e.g., flow rate or pressure of supply fluid or operating parameter of the bottomhole assembly). The circulation bypass 300 can be used to facilitate drilling operations and to selective increase the pressure/flow rate of the return fluid.

The motor bypass 310 selectively channels conveys fluid around the motor 200. The motor bypass 310 includes a valve 312 and a passage 314 formed through the motor rotor 202. A joint 316 connecting the motor rotor 202 to the first shaft 242 includes suitable passages (not shown) that allow the supply fluid to exit the rotor passage 314 and enter the supply flow path 290. Likewise, a pump bypass 320 selectively conveys fluid around the pump 220. The pump bypass includes a valve and a passage formed through the pump rotor 222 or housing. The pump bypass 320 can also be configured to function as a particle bypass line for the APD device. For example, the pump bypass can be adapted with known elements such as screens or filters to selectively convey cuttings or particles entrained in the return fluid that are greater than a predetermined size around the APD device. Alternatively, a separate particle bypass can be used in addition to the pump bypass for such a function. Alternately, a valve (not shown) in a pump housing 225 can divert fluid to a conduit parallel to the pump 220. Such a valve can be configured to open when the flow rate drops below a predetermined value. Further, the bypass device can be a design internal leakage in the pump. That is, the operating point of the pump 220 can be controlled by providing a preset or variable amount of fluid leakage in the pump 220. Additionally, pressure valves can be positioned in the pump 220 to discharge fluid in the event an overpressure condition or other predetermined condition is detected.

Additionally, an annular seal 299 in certain embodiments can be disposed around the APD device to direct the return fluid to flow into the pump 220 (or more generally, the APD device) and to allow a pressure differential across the pump 220. The seal 299 can be a solid or pliant ring member, an expandable packer type element that expands/contracts upon receiving a command signal, or other member that substantially prevents the return fluid from flowing between the pump 220 (or more generally, the APD device) and the casing or wellbore wall. In certain applications, the clearance between the APD device and adjacent wall (either casing or wellbore) may be sufficiently small as to not require an annular seal.

During operation, the motor 200 and pump 220 are positioned in a well bore location such as in a casing C. Drilling fluid (the supply fluid) flowing through the upper drill string section 260 enters the motor 200 and causes the rotor 202 to rotate. This rotation is transferred to the pump rotor 222 by the shaft assembly 240. As is known, the respective lobe profiles, size and configuration of the motor 200 and the pump 220 can be varied to provide a selected speed or torque curve at given flow-rates. Upon exiting the motor 200, the supply fluid flows through the supply flow path 290 to the lower drill string section 262, and ultimately the bottomhole assembly (not shown). The return fluid flows up through the wellbore annulus (not shown) and casing C and enters the cutting mill 270 via a inlet 293 for the return flow path 292. The flow goes through the cutting mill 270 and enters the pump 220. In this embodiment, the controller 180 (FIG. 1A) can be programmed to control the speed of the motor 200 and thus the operation of the pump 220 (the APD Device in this instance).

It should be understood that the above-described arrangement is merely one exemplary use of positive displacement motors and pumps. For example, while the positive displacement motor and pump are shown in structurally in series in FIGS. 4A–D, a suitable arrangement can also have a positive displacement motor and pump in parallel. For example, the motor can be concentrically disposed in a pump.

Figure 5A:
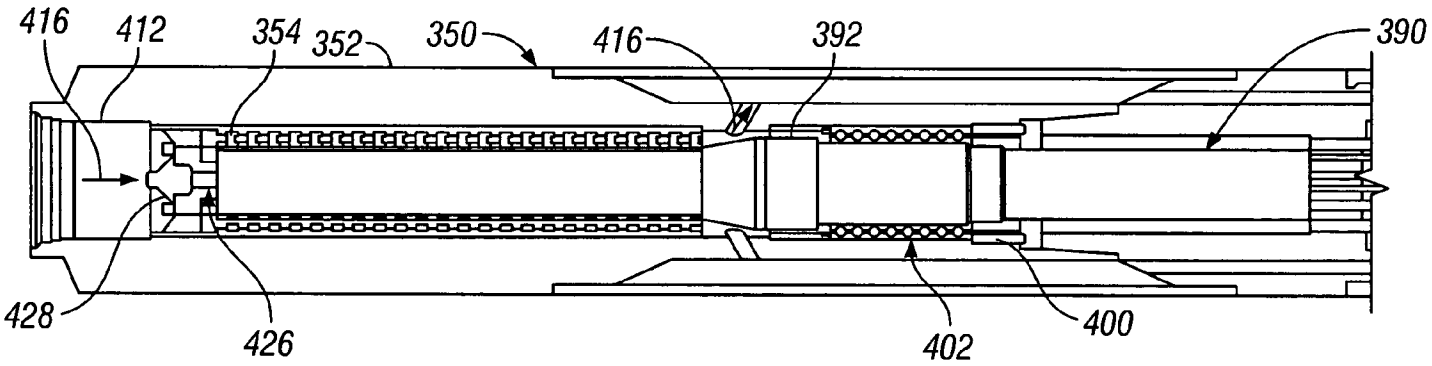
FIGS. 5A and 5B are schematic illustrations of one embodiment of an arrangement according to the present invention wherein a turbine drive is coupled to a centrifugal pump (the APD Device)
Figure 5B:
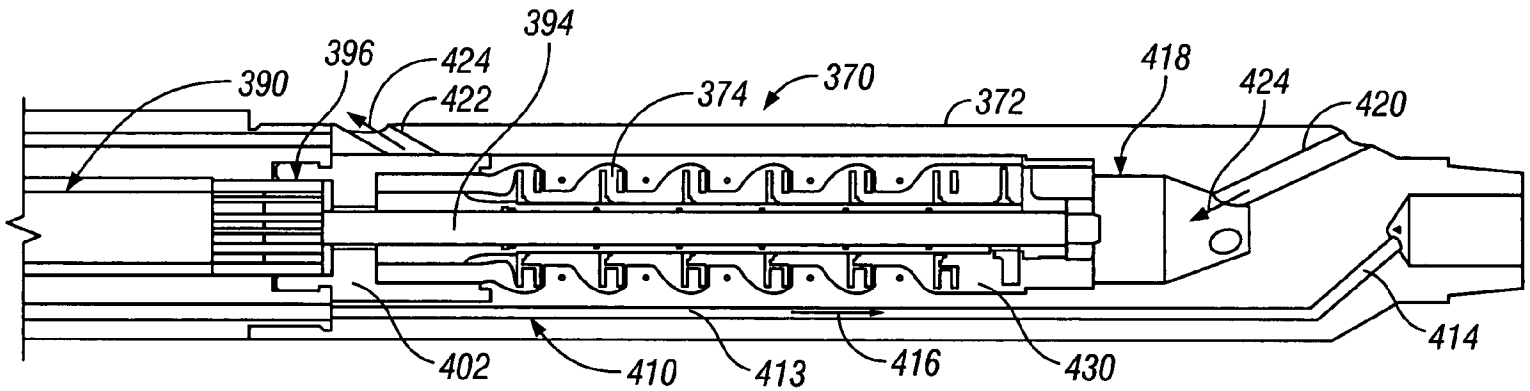

Referring now to FIGS. 5A–B, there is schematically illustrated one arrangement wherein a turbine drive 350 is coupled to a centrifugal-type pump 370 via a shaft assembly 390. The turbine 350 includes stationary and rotating blades 354 and radial bearings 402. The centrifugal-type pump 370 includes a housing 372 and multiple impeller stages 374. The design of turbines and centrifugal pumps are known to one skilled in the art and will not be discussed in further detail.

The shaft assembly 390 transmits the power generated by the turbine 350 to the centrifugal pump 370. One preferred shaft assembly 350 includes a turbine shaft 392 connected to the turbine blade assembly 354, a pump shaft 394 connected to the pump impeller stages 374, and a coupling 396 for joining the turbine and pump shafts 392 and 394.

The FIGS. 5A–B arrangement also includes a supply flow path 410 for channeling supply fluid shown by arrows designated 416 and a return flow path 418 to channel return fluid shown by arrows designated 424. The supply flow path 410 includes an inlet 412 directing supply fluid into the turbine 350 and an axial passage 413 that conveys the supply fluid exiting the turbine 350 to an outlet 414. The return flow path 418 includes an inlet 420 that directs return fluid into the centrifugal pump 370 and an outlet 422 that channels the return fluid into the casing C interior or wellbore annulus. A high pressure seal 400 is interposed between the flow paths 410 and 418 to reduce fluid leaks, particularly from the high pressure fluid in the supply flow path 410 into the return flow path 418. A small leakage rate is desired to cool and lubricate the axial and radial bearings. Additionally, a bypass 426 can be provided to divert supply fluid from the turbine 350. Moreover, radial and axial forces can be borne by bearing assemblies 402 positioned along the shaft assembly 390. Preferably a comminution device 373 is provided to reduce particle size entering the centrifugal pump 370. In a preferred embodiment, one of the impeller stages is modified with shearing blades or elements that shear entrained particles to reduce their size. In certain arrangements, a speed or torque converter 406 can be used to convert a first speed/torque of the motor 350 to a second speed/torque for the centrifugal pump 370. It should be understood that any number of arrangements and devices can be used to transfer power, speed, or torque from the turbine 350 to the pump 370. For example, the shaft assembly 390 can utilize a single shaft instead of multiple shafts.

It should be appreciated that a positive displacement pump need not be matched with only a positive displacement motor, or a centrifugal pump with only a turbine. In certain applications, operational speed or space considerations may lend itself to an arrangement wherein a positive displacement drive can effectively energize a centrifugal pump or a turbine drive energize a positive displacement pump. It should also be appreciated that the present invention is not limited to the above-described arrangements. For example, a positive displacement motor can drive an intermediate device such as an electric motor or hydraulic motor provided with an encapsulated clean hydraulic reservoir. In such an arrangement, the hydraulic motor (or produced electric power) drives the pump. These arrangements can eliminate the leak paths between the high-pressure supply fluid and the return fluid and therefore eliminates the need for high-pressure seals. Alternatively, a jet pump can be used. In an exemplary arrangement, the supply fluid is divided into two streams. The first stream is directed to the BHA. The second stream is accelerated by a nozzle and discharged with high velocity into the annulus, thereby effecting a reduction in annular pressure. Pumps incorporating one or more pistons, such as hammer pumps, may also be suitable for certain applications.

Figure 6A:
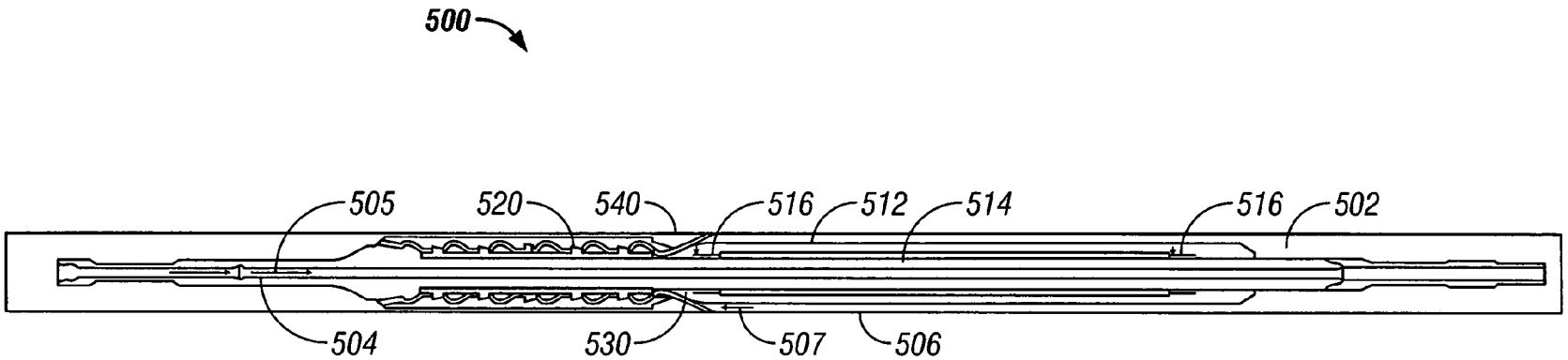
FIG. 6A is a schematic illustration of an embodiment of an arrangement according to the present invention wherein an electric motor disposed on the outside of a drill string is coupled to an APD Device.

Referring now to FIG. 6A, there is schematically illustrated one arrangement wherein an electrically driven pump assembly 500 includes a motor 510 that is at least partially positioned external to a drill string 502. In a conventional manner, the motor 510 is coupled to a pump 520 via a shaft assembly 530. A supply flow path 504 conveys supply fluid designated with arrow 505 and a return flow path 506 conveys return fluid designated with arrow 507. As can be seen, the FIG. 6A arrangement does not include leak paths through which the high-pressure supply fluid 505 can invade the return flow path 506. Thus, there is no need for high pressures seals.

In one embodiment, the motor 510 includes a rotor 512, a stator 514, and a rotating seal 516 that protects the coils 512 and stator 514 from drilling fluid and cuttings. In one embodiment, the stator 514 is fixed on the outside of the drill string 502. The coils of the rotor 512 and stator 514 are encapsulated in a material or housing that prevents damage from contact with wellbore fluids. Preferably, the motor 510 interiors are filled with a clean hydraulic fluid. In another embodiment not shown, the rotor is positioned within the flow of the return fluid, thereby eliminating the rotating seal. In such an arrangement, the stator can be protected with a tube filled with clean hydraulic fluid for pressure compensation.

Figure 6B:
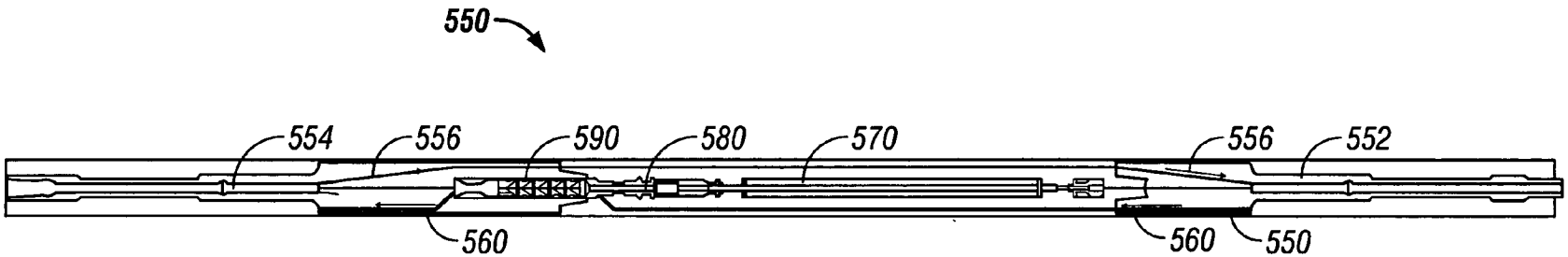
FIG. 6B is a schematic illustration of an embodiment of an arrangement according to the present invention wherein an electric motor disposed within a drill string is coupled to an APD Device.

Referring now to FIG. 6B, there is schematically illustrated one arrangement wherein an electrically driven pump 550 includes a motor 570 that is at least partially formed integral with a drill string 552. In a conventional manner, the motor 570 is coupled to a pump 590 via a shaft assembly 580. A supply flow path 554 conveys supply fluid designated with arrow 556 and a return flow path 558 conveys return fluid designated with arrow 560. As can be seen, the FIG. 6B arrangement does not include leak paths through which the high-pressure supply fluid 556 can invade the return flow path 558. Thus, there is no need for high pressures seals.

It should be appreciated that an electrical drive provides a relatively simple method for controlling the APD Device. For instance, varying the speed of the electrical motor will directly control the speed of the rotor in the APD device, and thus the pressure differential across the APD Device. Further, in either of the FIG. 6A or 6B arrangements, the pump 520 and 590 can be any suitable pump, and is preferably a multi-stage centrifugal-type pump. Moreover, positive displacement type pumps such a screw or gear type or moineau-type pumps may also be adequate for many applications. For example, the pump configuration may be single stage or multi-stage and utilize radial flow, axial flow, or mixed flow. Additionally, as described earlier, a comminution device positioned downhole of the pumps 520 and 590 can be used to reduce the size of particles entrained in the return fluid.

It will be appreciated that many variations to the above-described embodiments are possible. For example, a clutch element can be added to the shaft assembly connecting the drive to the pump to selectively couple and uncouple the drive and pump. Further, in certain applications, it may be advantages to utilize a non-mechanical connection between the drive and the pump. For instance, a magnetic clutch can be used to engage the drive and the pump. In such an arrangement, the supply fluid and drive and the return fluid and pump can remain separated. The speed/torque can be transferred by a magnetic connection that couples the drive and pump elements, which are separated by a tubular element (e.g., drill string). Additionally, while certain elements have been discussed with respect to one or more particular embodiments, it should be understood that the present invention is not limited to any such particular combinations. For example, elements such as shaft assemblies, bypasses, comminution devices and annular seals discussed in the context of positive displacement drives can be readily used with electric drive arrangements. Other embodiments within the scope of the present invention that are not shown include a centrifugal pump that is attached to the drill string. The pump can include a multi-stage impeller and can be driven by a hydraulic power unit, such as a motor. This motor may be operated by the drilling fluid or by any other suitable manner. Still another embodiment not shown includes an APD Device that is fixed to the drill string, which is operated by the drill string rotation. In this embodiment, a number of impellers are attached to the drill string. The rotation of the drill string rotates the impeller that creates a differential pressure across the device.

Figure 7:
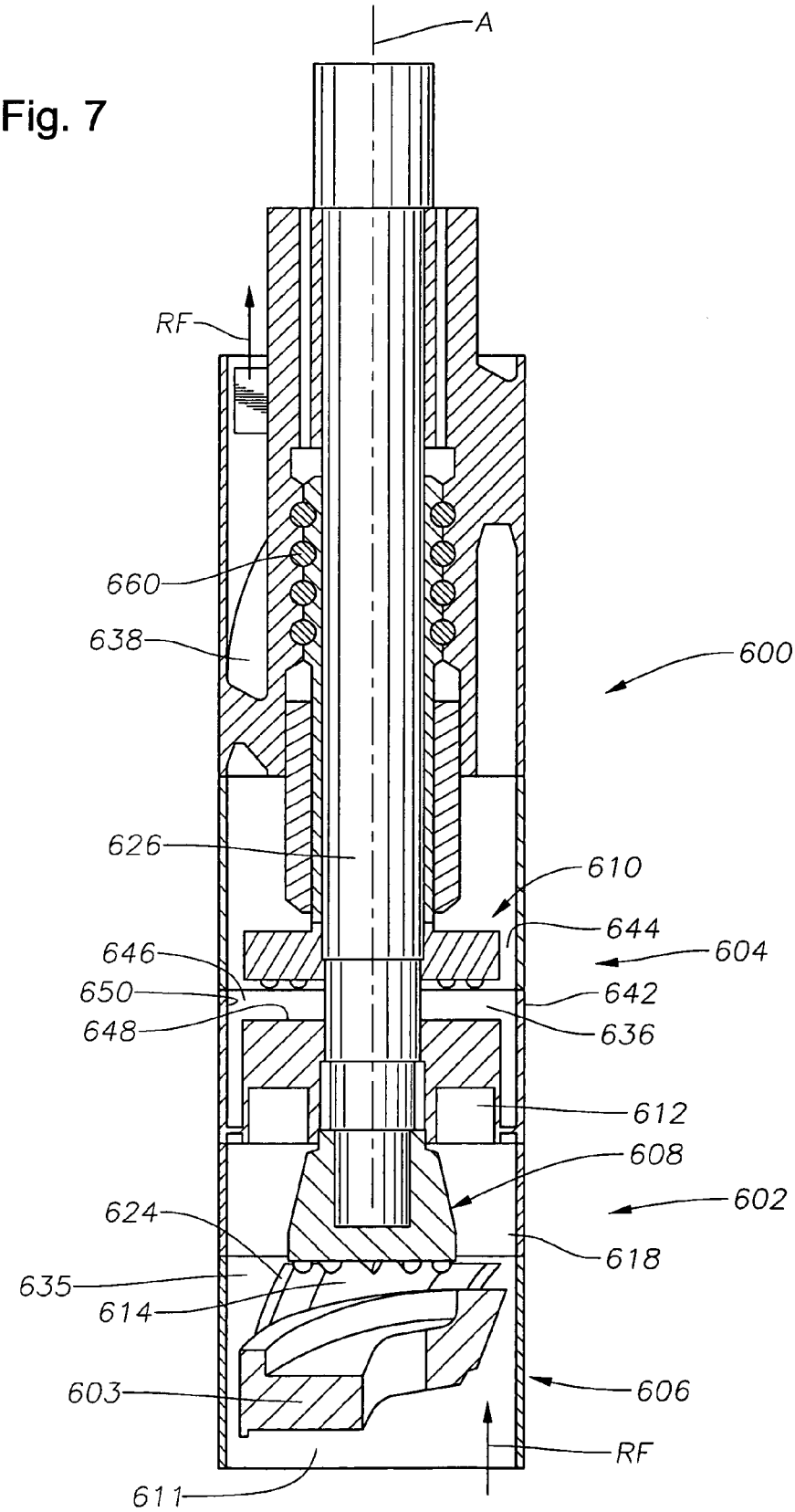
FIG. 7 schematically illustrates one embodiment of a comminution device made in accordance with the teachings of the present invention.

Referring now to FIG. 7, there is shown a comminution device 600 for reducing the size of particles entrained in the returning drilling fluid. These particles can include rock and earth cut by the drill bit, debris from the wellbore, pieces of broken wellbore equipment, and other known items. For brevity, the term "crush" or "crushing" is broadly used to encompass any mechanical force, such as compression or shearing, that breaks up or otherwise disintegrates the entrained particles. Preferably, the comminution device 600, which is positioned upstream of a selected wellbore device (e.g., the APD device 170 of FIG. 1), reduces the entrained particles to a size that will not jam, damage, or otherwise impair the operations of the selected wellbore device (e.g., APD device 170).

In the FIG. 7 embodiment, the device 600 includes a first stage 602 for reducing particles to a first selected size and a second stage 604 for reducing particles to a second selected size. The term selected size or predetermined size should be construed to cover ranges of selected or predetermined sizes as well. By way of a non-limiting illustration, the first stage 602 can reduce the diameter size of entrained particles to a range of approximately one hundred mm to forty-five mm and the second stage 604 can reduce the diameter size of entrained particles to a range of approximately fifty mm to ten mm. The ranges of particle reduction for the stages preferably overlap, but, this need not be the case. In one embodiment, each stage 602,604 is formed in a housing 606 wherein one or more cutting heads are disposed. Preferably, the comminution device 600 includes a first cutting head 608 and a second cutting head 610.

The first stage 602 has an inlet 611 in fluid communication with the return fluid and a passage 612 that directs flow into the second stage 604. The first cutting head 608 crushes entrained particles as they flow through a chamber 614 in the first stage 602. Preferably, the chamber 614 is formed to promote circulation of the drilling fluid and minimize the settling of entrained solids. Referring now to FIG. 8, for example, helix-like fins or ribs 616 formed on an inner wall 618 of the housing 606 "spin" or rotate the fluid such that the entrained particles circulate within the chamber 614. Further, the inner wall 618 can include raised portions 620 or sidewalls that prevent particles from settling along the outer perimeter of the chamber 614. Preferably, the housing 606 includes a first cutting surface 622 formed on a plane generally perpendicular to the longitudinal axis A of the device 600. This cutting surface 622 can include a ramped or inclined section to accommodate the flow or return drilling fluid. Preferably, a second cutting surface 624 is formed on the inner wall 618 of the housing 606. The first and second cutting surfaces 622,624 can include hardened surfaces adapted to withstand the forces and wear associated with the crushing or shearing of the entrained particles.

Referring now to FIGS. 7 and 9, the first cutting head 608 is fixed to a drive shaft 626 and thereby suspended within the housing chamber 614. The first cutting head 608 includes a first surface or face 628 that is generally perpendicular to the longitudinal axis A of the device 600 and a circumferential outer surface 630. In one embodiment, the first face 628 and circumferential outer surface 630 are provided with raised cutting members 632 adapted to shear and/or crush entrained particles. The cutting members 632 include inclined planar portions 634. Preferably, the cutting members 632 are configured such that the inclined planar portions 634 are aligned along multiple planes such that the entrained particles are subjected to different "angles of attack" for enhanced cutting. Thus, as the cutting head rotates, the first face cutting members 632 cooperate with the first cutting head 608 to reduce the size of particles flowing in a gap 635 therebetween. Likewise, the circumferential outer surface cutting members 632 cooperate with the second cutting surface 624 to reduce the size of particles traveling therebetween.

Figure 10:
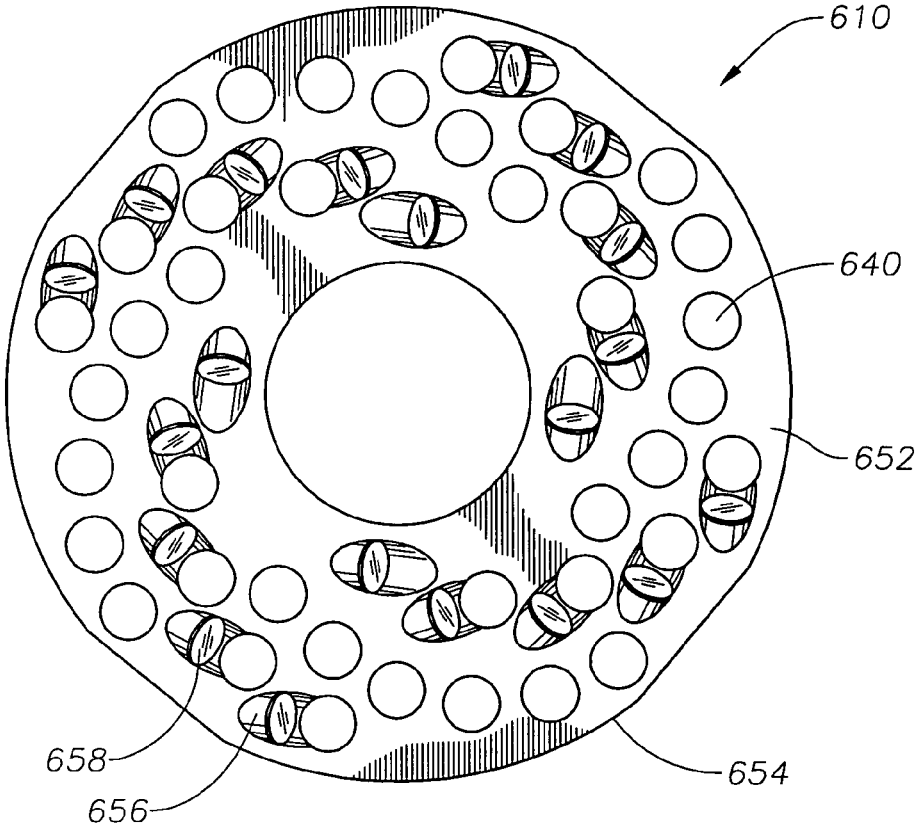
FIG. 10 schematically illustrates another exemplary cutting head for the FIG. 7 embodiment.

Referring now to FIG. 7, the second stage 604 has an inlet 636 in fluid communication with the first stage 602 and an exit 638 that directs flow to the selected wellbore device. Referring now to FIGS. 7 and 10, preferably, the second cutting head 610 is generally disk-shaped and includes a plurality of longitudinal flow bores 640. The size and number of the flow bores 640 will depend on the expected flow rate, size of entrained particles, and other factors known to one skilled in the art. The second stage cutting head 610 is fixed to the drive shaft 626 and thereby suspended in a chamber 642 formed in the housing 606. Preferably, the return fluid can flow through both the flow bores 640 or a gap 644 provided between the second stage cutting head 610 and an inner surface 646 of the housing 606. In other arrangements, return fluid flow can be directed to either the flow bores 640 or the gap 644. The second stage 604 has a first cutting surface 648 formed on a plane generally parallel perpendicular to the longitudinal axis A of the device 600. This cutting surface 648 can be inclined to accommodate the flow or return drilling fluid. A second cutting surface 650 is formed on the inner surface 646 of the housing 606. The first and second cutting surface 648,650 can include hardened surfaces adapted to withstand the forces and wear associated with the crushing or shearing of the entrained particles.

The second cutting head 610 includes a first face 652 that is generally perpendicular to the longitudinal axis A of the device 600 and a circumferential outer surface 654. In one embodiment, first face 652 and circumferential outer surface 654 are provided with raised cutting members 656 adapted to shear and/or crush entrained particles. The cutting members 656 are provided with inclined portions 658 having, preferably, multiple planar angles as described previously. Thus, as the second cutting head 610 rotates, the first face cutting members 656 cooperate with the first cutting surface 648 to reduce the size of particles traveling therebetween. Likewise, the circumferential outer surface cutting members 656 cooperate with the second cutting surface 650 to reduce the size of particles traveling therebetween. The second stage chamber 642 can also be formed to promote circulation of the drilling fluid and minimize the settling of entrained solids; e.g., members for "spinning" and preventing particles from settling along the outer perimeter of the chamber 642.

The drive shaft 626 can be rotated by a suitable connection to the APD device 170 (FIG. 1), to a downhole power source such an electric or hydraulic motor (not shown), or to the drill string 121 (FIG. 1). Also, suitable axial and radial bearings 660 are provided to stabilize the cutting heads 608,610 during operation. Also, the comminution device 600 includes crossover flow passages (not shown) for conveying supply fluid from a location uphole of the device 600 to a location downhole of the device 600.

Referring now to FIGS. 7–10, during operation, the return fluid RF enters the first stage chamber 614 via the housing inlet 603. The first cutting head 608 crushes the entrained particles to a selected size or range of sizes against the first cutting surface 622 with the cutting members 632 formed on the face 628. Cutting members 632 formed on the outer circumferential surface of the first cutting head 608 can also crush the entrained particles flowing through the gap 635. The drilling fluid and entrained particles flow through the passage 612 to the chamber 642 of the second stage 604. The second cutting head 610 further crushes the entrained particles to a smaller selected size or range of sizes. The entrained particles exit the chamber 642 after flowing though the second cutting head flow bores 640 and/or the gap 644 between the second cutting head 610 and housing 606. Thereafter, the return fluid and entrained cutting are directed to the downstream APD device 170 (FIG. 1).

Figure 11:
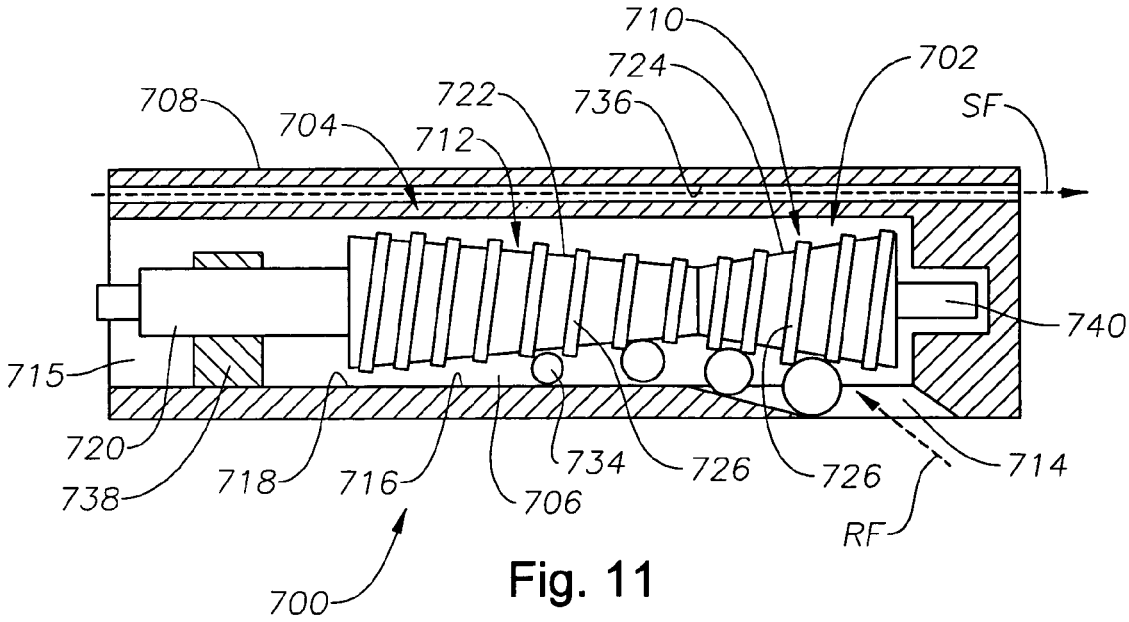
FIG. 11 schematically illustrated another embodiment of a comminution device made in accordance with the teachings of the present invention.

Referring now to FIG. 11, there is shown another comminution device 700 for reducing the size of particles entrained in the returning drilling fluid. In the FIG. 11 embodiment, the device 700 includes a first stage 702 for reducing particles to a first selected size and a second stage 704 for reducing particles to a second selected size. Each stage 702,704 is formed in a chamber 706 of a housing 708 wherein one or more cutting heads are disposed. In a preferred embodiment, the cutting heads include first and second frustoconical cutting rotors 710,712. In one embodiment, the angles of the rotors 710, 712 and the inlet in the housing are chosen such that the entrained solids are continuously resized. For example, the gap between the cutters and the cutting surface is made progressively smaller along the flow path of the entrained particles.

The housing 708 has an inlet 714 in fluid communication with the return fluid and an exit 715 that directs return fluid RF to the selected wellbore device. Preferably, the housing 708 includes a first cutting surface 716 formed on an interior circumferential surface 718. The first cutting surface 716 can include hardened surfaces adapted to withstand the forces and wear associated with the crushing or shearing of the entrained particles. The chamber 706 can also be formed to promote circulation of the drilling fluid and minimize the settling of entrained solids; e.g., members for "spinning" and preventing particles from settling along the outer perimeter of the chamber 706.

In a preferred embodiment, first and second frustoconical cutting rotors 710,712 are coupled in series to a shaft 720 and thereby suspended in the housing chamber 706. The frustoconical cutting rotors 710,712 are configured to crush entrained particles as they flow through a chamber 706. The cutting rotors 710,712 include an outer circumferential faces 722,724, respectively, that are provided with cutting members 726 adapted to crush entrained particles. The cutting members 726 include lobes, grooves, teeth and other structures for crushing entrained particles. The cutting members 726 can be of the same configuration on each of the rotors 710,712 or of different configurations. Moreover, each rotor 710, 712 can include cutting members 726 of different configurations. Preferably, the cutting members 726 are set at multiple different angles or planes such that the multiple angles of attack are available during the crushing action. Preferably, the first and second frustoconical cutting rotors 710,712 are arranged such that their smaller diameter ends are joined and their larger diameter ends are on opposing ends. Depending on the particular arrangement, the first and second frustoconical cutting rotors 710,712 can be of same or different lengths, inclination (gradient or slope), or diameter. Moreover, a flow gap 734 between the cutting rotors 710,712 and the housing 708 is preferably sized to minimize the risk of plugging while allowing sufficient cutting action between the cutting rotors 710,712 and the cutting surface 716.

The cutting rotors 710,712 are rotated by the drive shaft 720. The drive shaft 720 can be rotated by a suitable connection to the APD device, to a downhole power source such an electric or hydraulic motor, or to the drill string. Also, suitable axial/thrust bearings 740 and radial bearings 738 are provided to stabilize the cutting rotors 710,712 during operation. The comminution device 700 further includes crossover flow passages 736 for conveying supply fluid SF from a location uphole of the device 700 to a location downhole of the device 700.

It should be appreciated that the present invention is not limited to any particular number of rotors. In certain applications, a single cutting rotor may provide sufficient particle reduction. In other applications, three or more cutting rotors may be required to reduce entrained particles to a size that can pass through the APD device. Moreover, the rotors need not be frustoconical in shape. For example, they can be substantially cylindrical or include arcuate surface. Factors to be considered with respect to the number of rotors and configuration of the cutting rotor and housing 708 include the size of the flow passages in the APD device, available torque for rotating the cutting rotors, the expected drilling fluid flow rate, and the rock content (e.g., expected, size, density and nature of the particles).

During operation, the return fluid RF and entrained particles enters the chamber 706 via the inlet 714. The first cutting rotor 710 cuts or crushes the entrained particles to a selected size or range of sizes. The drilling fluid and entrained particles flow through the gap 732 between the first cutting rotor 710 and the housing 708 to the second cutting rotor 712, which further crushes the entrained particles to a smaller selected size or range of sizes. Thereafter, the return fluid and entrained cutting are directed to the downstream APD device (e.g., positive displacement pump).

It should be understood that the present invention is not limited to multi-stage particle reduction. In certain applications, a single stage may provide sufficient particle reduction. In other applications, three or more stages may be required to reduce entrained particles to a size that can pass through the selected wellbore device. Factors to be considered with respect to the number of stages and configuration of the cutting head and housing include the size of the flow passages in the APD device, available torque for rotating the cutting heads, the expected drilling fluid flow rate, and the rock content (e.g., expected, size, density and nature of the particles). Additionally, while the housing has been described as one element, the cutting heads can be housed in structurally separate housings. Moreover, the housing can be integral with the selected wellbore device. Further, it should be appreciated that the teachings of the present invention can be advantageously applied to any number of downhole applications wherein the size of particles in a return fluid are to be reduced in size in situ before returning to the surface. For instance, one or more independently operable comminution devices can be positioned along the drill string to adjust the density of the return fluid or to prevent the settling of larger particles along sections of the wellbore. In such instances, the particle reduction is controlled relative to selected parameter of the return fluid and not relative to the operating condition of a selected wellbore device.

Other embodiments, which are not shown, for reducing the size of particles include mills or devices wherein the axis of the rotational cutting action is generally parallel with the flow of the return fluid, which is usually along the longitudinal axis of the wellbore. In one embodiment, a housing can include a frustoconical chamber for receiving a cylindrical cutter. The return fluid enters at the larger diameter of the chamber and exits at the smaller diameter. The cutter can be formed as a worm conveyer that, when rotated, draws entrained cuttings from the larger diameter section of the chamber to the smaller diameter section of the chamber. The entrained particles are crushed as they flow through the gradually decreasing gap between the cutter and an inner wall defining the frustoconical chamber. In a related embodiment, the cylindrical cutter can be formed in a conical or frustoconical shape that generally conforms to the frustoconical shape of the chamber. The gradients or angles of the chamber and cutter are set such that these spacing between the surfaces of the chamber and the cutter gradually reduces from an entry point to an exit point.

In another embodiment, cutting members such as teeth may be formed on an inner surface of a cylindrical housing such as a stator. A rotor disposed in the stator crushed particles against the inner surface when rotated. The teeth have a profile and sufficient interstitial space for allowing solids to enter the inside of the stator. The height of the teeth gradually reduces in size so that the particles or solids cannot pass before they have been crushed between the stator and the rotor. Holes provided in the stator can be provided to allow particles of a selected size to exit the stator.

In another embodiment, three conical or frustoconical rolls are oriented is such a way so that the enveloped space between the rolls has a conical shape. The diameter of the rolls becomes smaller with travel length of the solids allowing a continuous resizing of particles. One centrally disposed roll drives the other adjacent rolls. In another embodiment, a roller bit rotates on a plate. The roller bit includes wheel-like members that roll on the plate. During operation, roller bit rotation causes the wheel-like members to roll over and crush particles, which exit the roller bit via holes.

In still other embodiments, the drive source or rotating action for crushing particles may be perpendicular to the flow of the return fluid. For instance, two rollers may be positioned in a spaced-apart parallel orientation. In one embodiment, the two rollers are rotated in opposite directions such that solids and particles are pulled into the space between the rollers and crushed. In another embodiment, the rollers rotate in the same direction but at different rotational speeds. The particles, while being drawn between the rollers, are rotated, which provides flexible load points and enhances the crushing action. In yet another embodiment, one rotating roll works against a non-rotating plate to crush the particles. The rotating roll can include teeth having specified spacing. The distance between the roll and the plate and the space between the teeth determine the maximum size of the reduced particles.

In yet other embodiments, housing includes a rotating disk that has a plurality of radially oriented pistons. During disk rotation, centrifugal force urges the pistons move out of the disk. The rotating disk is disposed in a cavity or chamber such that during one part of the rotation, a wall of the chamber prevents the pistons from emerging from the disk and in another part of rotation, a gap is provided such that the piston can protrude from the disk. During operation, larger particles entering this gap are struck by the piston and crushed. Other particles are crushed between the disk and the wall of the chamber. In still other embodiments, a mortar can be used to crush solids.

In another embodiment, a hammer is disposed in a chamber and reciprocates along an axis transverse to the flow of drilling fluid through the chamber. A rod or other connecting member fixed to the hammer drives the hammer in an oscillating fashion against opposing walls defining the chamber. The entrained cuttings are crushed between the hammer and the walls. Biasing members such as springs coupled to the hammer can allow resonance operation.

In another embodiment, the drilling fluid is directed between a pair of opposing stamps. One or both of the stamps, which are plate-like members, can include flow holes through which entrained particles of a specified diameter can exit. The stamps move together squeezing entrained particles therebetween.

In another embodiment, a screen is positioned upstream of the wellbore device. Only particles of a preselected size can pass through the screen. Once the screen is plugged with larger size particles, a bypass is opened to transport the larger cuttings past the wellbore device. Also, the particles can be collected in a tank or chamber and periodically conveyed to the surface. The particles can also be stored in the formation.

In still other embodiments, chemical, electrical, thermal, or wave energy can be used to disintegrate and reduce the size of entrained particles. For instance, an aggressive chemical can be injected into the return fluid. The chemical can either dissolve the particles or sufficiently soften the particles such that the particles disintegrate upon entering the wellbore device or perhaps by rubbing against the wellbore wall. The chemical can be supplied from a downhole reservoir that is periodically replenished by a fluid line to the surface or directly injected from such a fluid line. Embodiments utilizing electrical energy can include spark drilling, which can use electrical energy to evaporate entrained particles. The discharge point for the electrical energy can be integrated into a drill bit or positioned in the return fluid uphole of the drill bit. Other embodiments use a laser positioned proximate or uphole of the drill bit. The laser can produce a continuous or periodic beam that cuts the particles crossing the beam. In still other embodiments, the entrained particles are subjected to ultrasonic waves. The source for the ultrasonic source can be positioned proximate or uphole of the drill bit and reduce the size of particles entering an established wave field. It should be understood that the above-described embodiments can be combined with the described mechanical arrangements and methods for reducing the size of entrained particles. For instance, the larger size particles trapped by the screen can be collected in a chamber, as described previously, and then subjected to chemical, electrical, thermal, or wave energy. Thus, the reduction process is made more efficient by focusing or limiting the discharge of energy to only the larger sized particles.

While the foregoing disclosure is directed to the preferred embodiments of the invention, various modifications will be apparent to those skilled in the art. For example, while a stator has been described as a cutting surface, the rotor or other cutting member can crush entrained particles against a wellbore wall, thereby eliminating the direction of return fluid into a chamber. It is intended that all variations within the scope and spirit of the appended claims be embraced by the foregoing disclosure.

What is claimed is:

1. An apparatus for reducing the size of particles entrained in a drilling fluid returning up a wellbore, comprising:

(a) a housing disposed in a wellbore upstream of a selected wellbore device, an inlet in fluid communication with the return fluid, an exit for directing the return fluid to said selected wellbore device, and a first stage including:

(i) at least one cutting surface formed in a chamber formed in said housing; and (ii) a cutting head disposed in said chamber, said cutting head cooperating with said at least one cutting surface to reduce the size of the particles entrained in the drilling fluid to a predetermined size.

2. The apparatus according to claim 1 wherein said cutting head includes cutting members formed on at least two surfaces on different planes, and wherein said at least one cutting surface includes a plurality of cutting surfaces positioned in cooperative relation to said cutting members.

3. The apparatus according to claim 1 wherein an inner wall of said housing is configured to spin the return fluid in said chamber.

4. The apparatus according to claim 1 wherein an inner wall of said housing is configured to minimize the settling of entrained particles in said chamber.

5. The apparatus according to claim 1 wherein said cutting head is rotated by one of (i) a shaft coupled to said selected wellbore device, (ii) a motor, and (iii) a drill string.

6. The apparatus according to claim 1 wherein a gap is provided between said cutting head and an inner wall of said housing, said gap being sized for allowing the return fluid to exit said chamber.

7. The apparatus according to claim 1 wherein said selected device is one of (i) a positive displacement pump; (ii) a centrifugal pump, and (iii) a jet pump.

8. The apparatus according to claim 1 wherein said cutting head comprises a rotor having a circumferential outer surface having cutting members provided thereon, and said at least one cutting surface is formed an inner surface of said housing.

9. The apparatus according to claim 1 wherein said cutting head includes a first section formed to reduce the entrained particles to said predetermined size and a said second section formed to reduce the entrained particles to a second predetermined size.

10. The apparatus according to claim 1 wherein said housing further comprises a second chamber including at least one cutting surface formed in said second chamber formed in said housing; and a second cutting head disposed in said second chamber, said second cutting head cooperating with said at least one cutting surface of said second chamber to reduce the size of the particles entrained in the drilling fluid to a second predetermined size.

11. The apparatus according to claim 10 wherein said second cutting head includes a plurality of flow bores for allowing the return fluid to exit said second chamber.

12. The apparatus according to claim 10 wherein a flow gap is provided between said second cutting head and an inner wall of said housing such that the return fluid can flow through said flow gap.

13. The apparatus according to claim 10 wherein said cutting head and said second cutting head include a plurality of cutting members having inclined portions aligned on at least two different planes.

14. The apparatus according to claim 10 wherein said at least one cutting surface of said first and second chambers include at least two cutting surfaces, and wherein said cutting head includes a plurality of cutting members arranged in cooperative relationship with said at least two cutting surfaces of said first stage, said second cutting head include a plurality of cutting members arranged in cooperative relationship with said at least two cutting surfaces of said second chamber.

15. An wellbore device for processing the size of particles entrained in a drilling fluid returning up a wellbore (the "return fluid"), comprising:

(a) a housing disposed in the wellbore, the housing having an inlet in fluid communication with the return fluid and including:

(i) a first chamber for reducing the size of the particles entrained in the drilling fluid to a first predetermined size by disintergrating the particle; and (ii) a second chamber for reducing the size of the particles entrained in the drilling fluid to a second predetermined size.

16. The wellbore device according to claim 15 wherein said housing has an outlet in fluid communication with one of (i) a positive displacement pump; (ii) a centrifugal pump; and (iii) a jet pump.

17. The wellbore device according to claim 15 wherein said first and second chambers each include a crushing member for reducing the size of the entrained particles.

18. The wellbore device according to claim 17 wherein said crushing members of said first and second chambers are configured to continuously reduce the size of the entrained particles.

19. A wellbore device for processing the size of particles entrained in a drilling fluid returning up a wellbore (the "return fluid"), comprising:

(a) an operator positioned in the wellbore in fluid communication with the return fluid, said operator generating an energy field that reduces the size of the particles entrained in the drilling fluid to a first predetermined size when the particles flow through the energy field.

20. The wellbore device according to claim 19 wherein the energy field is selected from a group consisting of (i) sonic, (ii) thermal, (iii) chemical, and (iv) electrical.

21. A method for reducing the size of particles entrained in a drilling fluid returning up a wellbore, comprising:

(a) disposing a housing in a wellbore;

(b) providing fluid communication between the return fluid and chamber associated with the housing;

(c) reducing the size of the particles entrained in the drilling fluid to a predetermined size by disintergrating the particles as the particles flow through the chamber; and (d) directing the return fluid from the housing to a selected wellbore device.

22. The method according to claim 21 further comprising spinning the return fluid in the chamber.

23. The method according to claim 21 rotating a cutting head positioned in the chamber by one of (i) a shaft coupled to said selected wellbore device, (ii) a motor, and (iii) a drill string, the cutting head thereby reducing the size of the particles entrained in the return fluid.

24. The method according to claim 21 wherein the selected device is one of (i) a positive displacement pump; (ii) a centrifugal pump, and (iii) a jet pump.

25. The method according to claim 21 further comprising reducing the size of the entrained particles continuously as the entrained particles flow through the chamber.

26. The method according to claim 21 further comprising providing a first and second stage for the chamber; reducing the entrained particles to a first predetermined size in the first stage; and reducing the entrained particles to a second predetermined size in the second stage.

27. The method according to claim 21 further comprising producing an energy field in the chamber with an operator, the energy field reducing the size of the particles entrained in the drilling fluid to the first predetermined size when the particles flow through the energy field.

28. The method according to claim 27 wherein the energy field is selected from a group consisting of (i) sonic, (ii) thermal, (iii) chemical, and (iv) electrical.

29. A system for drilling a wellbore in a subterranean formation, comprising:

(a) a drill string having a drill bit at an end thereof, the drill bit forming cuttings during drilling that are entrained in a drilling fluid flowing up the wellbore;

(b) an active pressure differential device (AFD Device) positioned in the wellbore controlling pressure of the drilling fluid flowing up the wellbore;

(c) a controller controlling the APD Device; and (d) a comminution device positioned in the wellbore adapted to reduce the size of the particles entrained in the drilling fluid by disintegrating the particles.

30. The apparatus according to claim 29 wherein said comminution device is operated by one of (i) a motor, and (ii) a drill string.

31. The apparatus according to claim 29 wherein the APD Device is one of (i) a positive displacement pump; (ii) a centrifugal pump, and (iii) a jet pump.

32. A method for drilling a wellbore in a subterranean formation, comprising:

(a) providing a drill string having a drill bit at an end thereof, the drill bit forming cuttings during drilling that are entrained in a drilling fluid flowing up the wellbore;

(b) controlling pressure of the drilling fluid flowing up the wellbore using an active pressure differential device (APD Device) positioned in the wellbore;

(c) controlling the APD Device with a controller; and (d) disintegrating the cuttings entrained in the drilling fluid using a comminution device positioned in the wellbore.

33. The method according to claim 32 further comprising operating the comminution device using one of (i) a motor, and (ii) a drill string.

34. The method according to claim 32 wherein the APD Device is one of (i) a positive displacement pump; (ii) a centrifugal pump, and (iii) a jet pump.

* * * * *